US006799738B2

(12) United States Patent
Sauder et al.

(10) Patent No.: US 6,799,738 B2
(45) Date of Patent: Oct. 5, 2004

(54) TAKE-UP REEL WITH UNI-DIRECTIONAL SPEED GOVERNED RETRACTOR

(75) Inventors: Gerald D. Sauder, Chandler, AZ (US); Andre J. Baca, Tempe, AZ (US); Jeff Knosalla, Gilbert, AZ (US)

(73) Assignee: Coxwells, Inc., Tempe, AZ (US)

( * ) Notice: Subject to any disclaimer, the term of this patent is extended or adjusted under 35 U.S.C. 154(b) by 0 days.

(21) Appl. No.: 09/841,473

(22) Filed: Apr. 24, 2001

(65) Prior Publication Data

US 2001/0048043 A1 Dec. 6, 2001

Related U.S. Application Data

(63) Continuation-in-part of application No. 09/323,300, filed on Jun. 1, 1999, now Pat. No. 6,234,417.

(51) Int. Cl.[7] ..... B65H 75/48
(52) U.S. Cl. ..... 242/381
(58) Field of Search ..... 242/381, 381.5; 254/377

(56) References Cited

U.S. PATENT DOCUMENTS 3,211,396 A * 10/1965 McQillen ..... 188/290
4,067,545 A * 1/1978 Singer ..... 104/173.2
4,446,884 A 5/1984 Rader, Jr. ..... 137/355.23
4,523,664 A 6/1985 Soubry et al. ..... 182/233
4,722,422 A * 2/1988 Hiraoka ..... 182/233
4,793,376 A 12/1988 Hare ..... 137/355.23
5,135,181 A 8/1992 Wesselink ..... 242/381.5
5,186,289 A * 2/1993 Wolner et al. ..... 182/232
5,794,878 A 8/1998 Carpenter et al. ..... 242/381
6,158,684 A * 12/2000 Hedlund ..... 137/355.23
6,234,417 B1 * 5/2001 Sauder et al. ..... 242/381
6,237,959 B1 * 5/2001 Hishon ..... 242/381

* cited by examiner

*Primary Examiner*—Kathy Matecki
*Assistant Examiner*—Scott J. Haugland
(74) *Attorney, Agent, or Firm*—John D. Titus

(57) ABSTRACT

A take-up reel for winding and storing an elongate hose or electrical cable comprises a reel that is rewound by a torsional spring. A viscous clutch is coupled to the reel by means of a unidirectional clutch, which engages the viscous clutch to the reel to rewind the reward speed, but disengages the viscous clutch from the reel when the hose or cable is being payed-out. This permits the hose or cable to be payed-out without resistance from the viscous clutch. The uni-directional viscous clutch assembly thus allows the hose to be payed-out at any speed while providing the substantial safety benefits of a viscous speed governor during rewind.

21 Claims, 5 Drawing Sheets

A
66
68
104
106
108
110
112
114
116
32
34
52
50
22
48
12
24B
26
30
58
24A
42
40
24
28
36
38
44
46
18

TAKE-UP REEL WITH UNI-DIRECTIONAL SPEED GOVERNED RETRACTOR

This application is a continuation-in-part of application Ser. No. 09/323,300 filed Jun. 1, 1999, now U.S. Pat. No. 6,234,417.

BACKGROUND

The present invention relates to take-up reels of the type for winding and paying out an elongated flexible member such as a cable, cord or hose, and which automatically rewind the flexible member when it is released.

The art is replete with apparatus in which a flexible member such as a cable, rope, hose, electrical cord or the like is wound about a take-up reel for storage when not in use, and which is paid out by unwinding from the take-up reel to the appropriate length as required. A popular application for this arrangement is use of a flexible hose for carrying air, water, oil, or grease from a reservoir to a dispensing nozzle at an automobile service station. For example, in the typical automobile service station, air is delivered from a compressor tank through a long pipe to a spring-loaded take-up reel about which is stored a length of tubular air hose. When air is needed, the air hose is pulled from the reel until the desired length is paid out. When the air hose is no longer in use, the end is released and a torsional spring acting on the hose reel rewinds the hose onto the reel.

The torque exerted by the torsional spring on the take-up reel causes the take-up reel, and with it the payed-out hose, to accelerate as the hose is taken up, with result that the terminal velocity of the hose may be quite high as the last bit of hose is retracted. The sudden stop of the mechanism when the end of the hose is reached can cause damage to the rewind mechanism and/or the hose. Moreover, it would be advantageous to reduce the possibility that the whipping action occurring as a result of the uncontrolled rewinding speed might cause personal injury. Various braking mechanisms have been proposed for automatically limiting the rewind rate of the take-up reel. For example, U.S. Pat. No. 4,446,884 to Rader, Jr. proposes use of a viscous damping mechanism coupled between the spool and its support shaft. Being a viscous damper, the retarding force exerted by the viscous damper is directly proportional to the rotational speed of the reel. Accordingly, the reel will tend to seek a velocity at which the retarding force is equal to the force exerted on the reel by the torsional spring, such that the spool will attain a constant velocity. The viscous damper disclosed in Rader, however, is rigidly attached to the support shaft and therefore exerts a retarding force on the hose reel irrespective of whether the hose is being payed-out or being retracted. In most applications, it is not necessary to regulate the speed at which the hose is payed-out. Accordingly, a viscous damper that operates in both directions such as disclosed by Rader unnecessarily loads the hose as it is being payed-out, potentially leading to premature failure of the hose and/or the rewind mechanism. Accordingly, what is needed is a take-up reel with a viscous clutch that operates only when the hose is being retracted and allows the hose reel to be decoupled from the viscous dampener when the hose is being payed-out.

SUMMARY OF THE INVENTION

The present invention satisfies the foregoing need by providing a hose reel assembly having a unidirectional viscous damper assembly. In the illustrative embodiment, the unidirectional viscous damper assembly consists of a viscous clutch and a unidirectional clutch. The viscous clutch is operatively coupled between the hose reel and the stationary support by means of the unidirectional clutch that engages the viscous clutch only when the hose reel is rewinding, not when the hose reel is paying-out the hose. The take-up reel comprises a stationary support shaft attached to a frame and a unidirectional clutch assembly supported for rotation by the stationary support shaft. The unidirectional clutch assembly is capable of rotating freely in one direction about the stationary support shaft but engages the stationary support shaft to prevent rotation in the opposite direction. The unidirectional clutch, in turn, is secured to a plurality of stator disks of a multidisk viscous clutch. The rotor disks of the viscous clutch, in turn, are coupled to the hose reel. A chamber filled with a viscous fluid encloses the stator and rotor disks. The viscous fluid provides a shearing action to retard the relative motion between the stator disks attached to the unidirectional clutch assembly and the rotor disks attached to the hose reel. The multi-plate construction of the viscous clutch provides a highly efficient and compact retarding mechanism. A conventional torsional spring provides a biased urging the reel to fully rewind the hose wound thereon.

In operation, as the hose is payed out, a shearing force develops between the rotor disks coupled to the hose reel and the stator disks coupled to the unidirectional clutch. The shearing force exerts a slight torque on the unidirectional clutch causing the unidirectional clutch to disengage and freewheel about the stationary support shaft. Thus, the only resistance force exerted by the viscous clutch assembly opposing this direction of motion is the torque necessary to overcome the friction inherent in the unidirectional clutch. Conversely, when the reel is being retracted under the urging of the torsional spring, a shearing force is developed between the rotor disks attached to the hose reel and the stator disks attached to the unidirectional clutch. In this direction, however, the unidirectional clutch engages the stationary support shaft thereby preventing rotation of the stator disks. The shearing force developed between the now static stator disks and rotor disks is proportional to the relative velocity between the stator disks and the rotor disks. Accordingly, as the rewind velocity of the hose reel builds, a counteracting torque is developed by the shearing of the viscous fluid between the stator and rotor disks until at a certain velocity, the forces balance and the hose reel attains a steady-state velocity. The steady-state velocity may be adjusted by, among other things, adjusting the viscosity of the fluid in the viscous clutch and/or varying the number of stators and rotors and their relative spacing.

By providing a uni-directional viscous clutch that acts to retard only the take-up velocity of the hose reel, it is possible to provide an apparatus that permits the hose to be payed-out at any speed without resistance from the viscous clutch while providing the substantial benefits of a viscous speed governor during take-up. The invention thus provides all of the safety benefits of a viscous speed governor without the unnecessary wear and tear inherent in a conventional bi-directional viscous clutch.

BRIEF DESCRIPTION OF THE DRAWING

The present invention will be better understood from reading of the following detailed description, taken in conjunction with the accompanying drawing figures in which like references designate like elements, and in which.

DETAILED DESCRIPTION

Figures 1, 3:
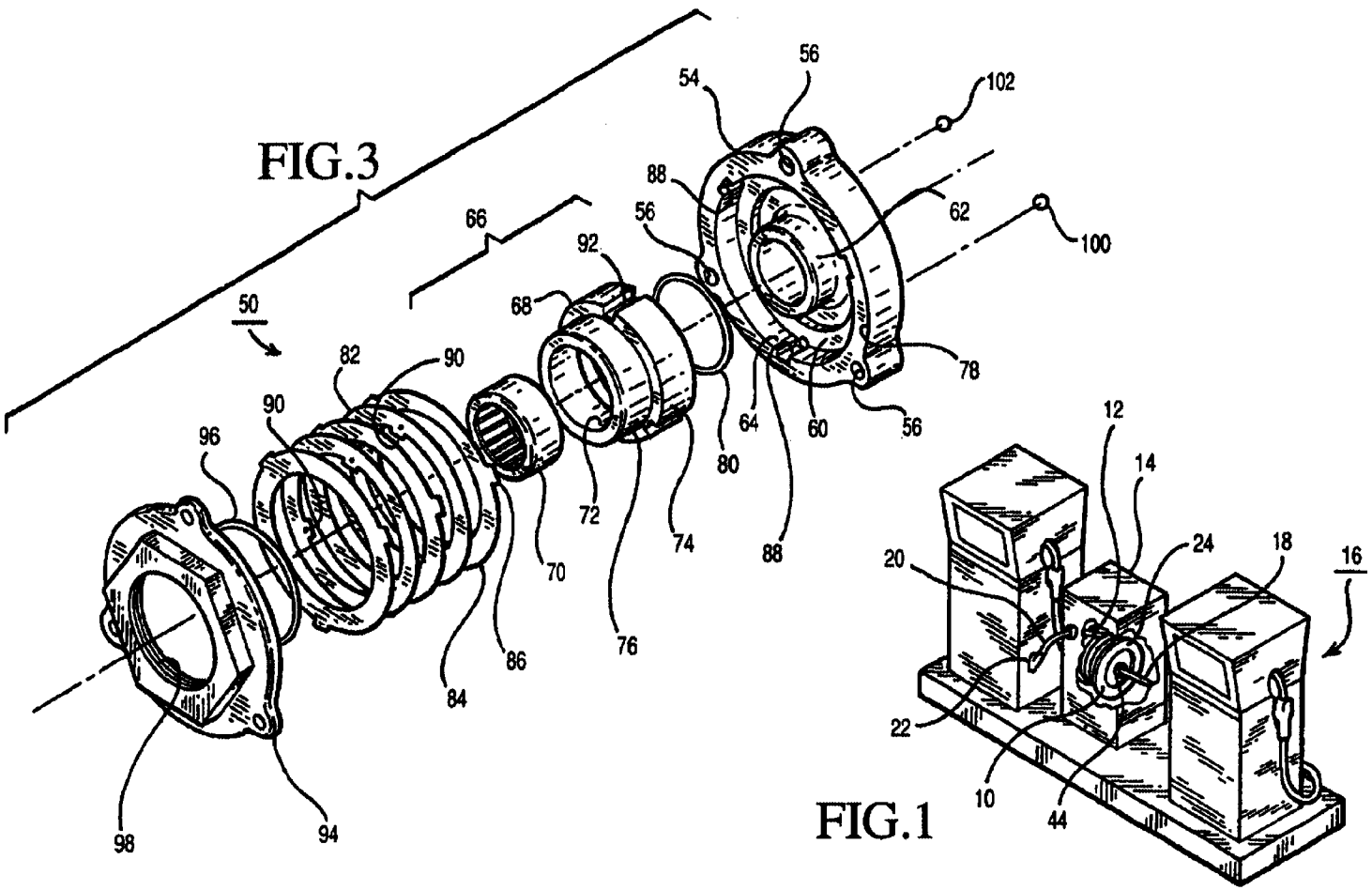
FIG. 1 is a perspective view of typical application of a hose reel retractor incorporating features of the present invention.
FIG. 3 is an exploded perspective view of the viscous clutch and unidirectional clutch assemblies of the hose reel of FIG. 2.

The drawing figures are intended to illustrate the general manner of construction and are not necessarily to scale. In the description and in the claims, the terms left, right, front and back and the like are used for descriptive purposes. However, it is understood that the embodiment of the invention described herein is capable of operation in other orientations that is shown and the terms so used are only for the purpose of describing relative positions and are interchangeable under appropriate circumstances.

With reference to FIG. 1, a reel assembly 10 having a uni-directional viscous clutch assembly incorporating features of the present invention is illustrated, by way of example, as used for paying out and taking up a length of high-pressure air hose 12 from a cabinet 14 mounted to a service station island 16. In this application, high-pressure air is delivered from an air compressor (not shown) to a conventional swivel joint 44 which delivers it to the inlet of air hose 12. The terminal end 20 of air hose 12 is fitted with a conventional air chuck or other terminal apparatus 22. When it is desired to provide high-pressure air service, the terminal end 20 of air hose 12 is pulled from the reel assembly 10 to the desired length. When the length of air hose 12 is no longer needed, terminal end 20 is released by the user to allow reel assembly 10 to rewind the hose under the urging of a torsional spring acting on the reel 24 of reel assembly 10.

Figures 2, 4:
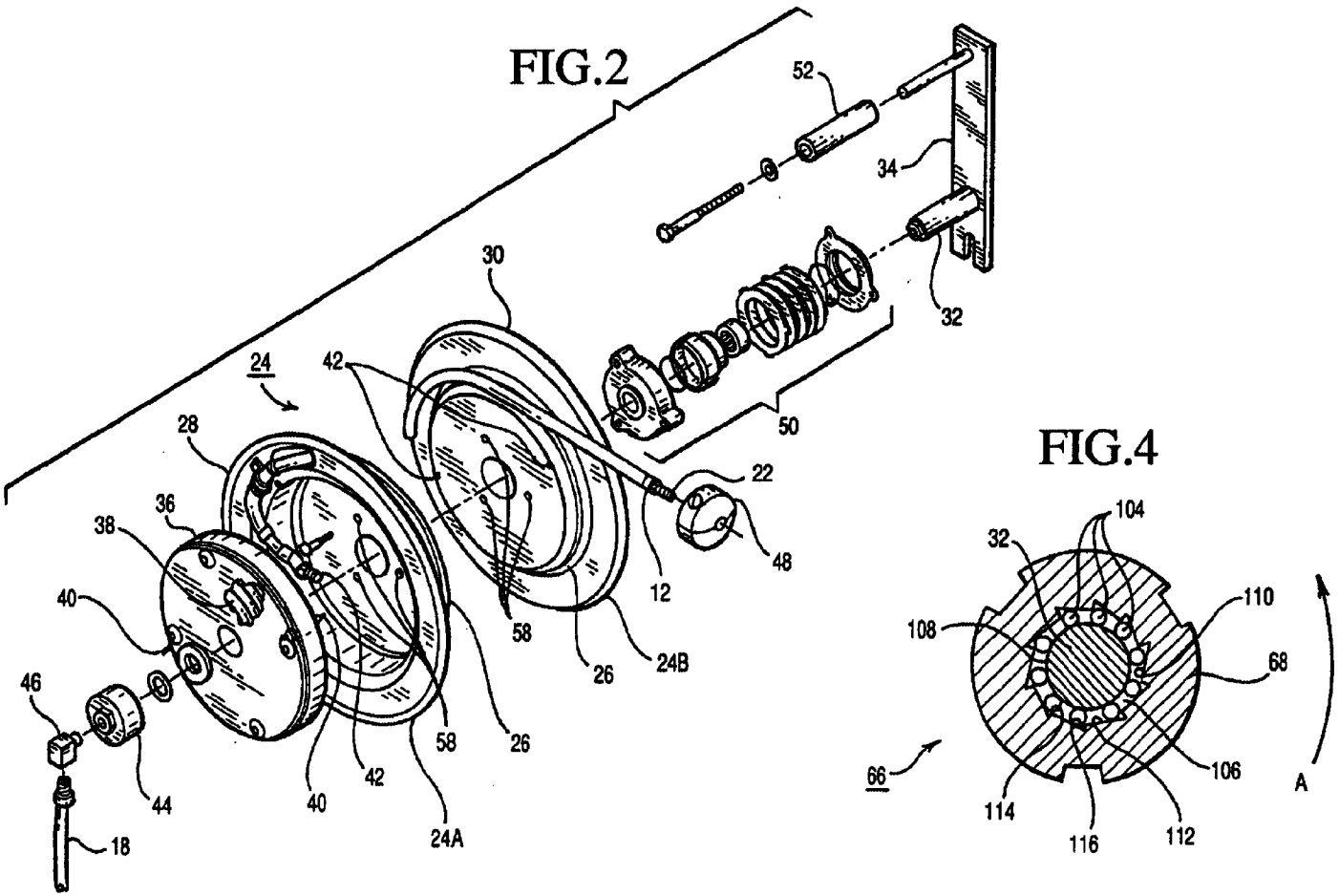
FIG. 2 is an exploded perspective view of a hose reel incorporating features of the present invention.
FIG. 4 is an end view of a ramp-and-ball unidirectional clutch assembly incorporating features of the present invention.
Figure 2A:
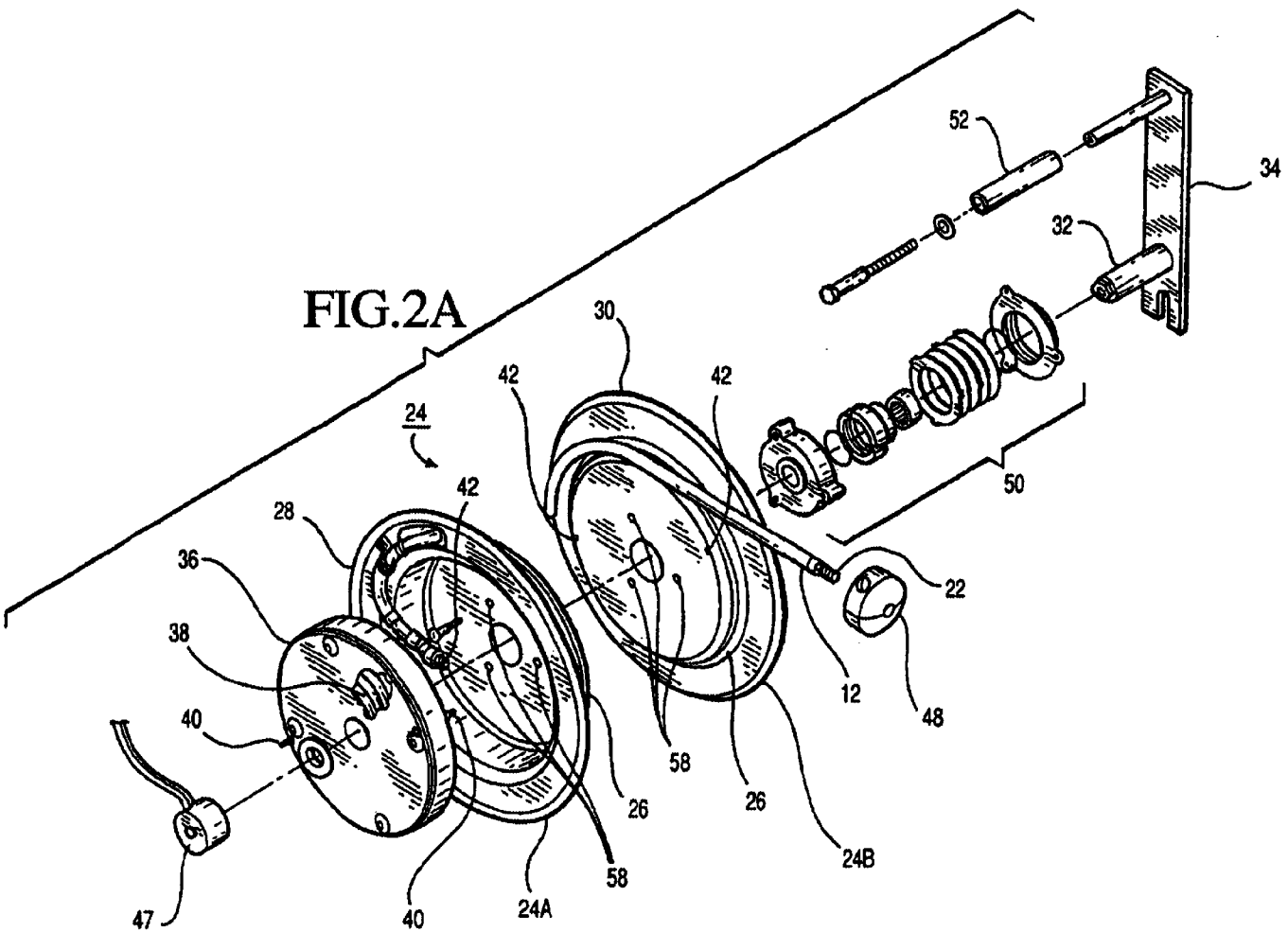
FIG. 2A is an exploded perspective view of an alternative embodiment of a take-up reel incorporating features of the present invention.

With reference to FIG. 2, reel 24 of reel assembly 10 comprises outer-reel half 24A and inner-reel half 24B which are secured together to form a reel 24 having a substantially cylindrical body portion 26 with radially extending flange portions 28 and 30 at the respective inner and outer ends thereof. Reel 24 is supported for rotation by a stationary support shaft 32 attached to subframe 34. Subframe 34 in turn may be mounted to a wall, frame, or to the interior surface of an enclosure such as enclosure 14 shown in FIG. 1. Disposed within cylindrical body portion 26 is a spring can 36 in which is housed a conventional multiple turn torsional spring 38. Spring 38 may be a spiral wound spring similar to a watch spring, or may be a conventional negator spring. The outer end of torsional spring 38 is secured to spring can 36. The inner end of torsional spring 38 is secured to stationary shaft 32 by means of a slot and setscrew, keyed hub, or other conventional means. Spring can 36 is secured within body portion 26 by a plurality of studs 40 passing through corresponding apertures 42 in inner and outer reel halves 24A and 24B. Inner-end 42 of air hose 12 is coupled to inlet line 18 by means of a conventional swivel joint 44 via elbow fitting 46. (In an alternative embodiment of reel assembly 10 in which an electrical cord is wound about reel 24, a conventional slip-ring connector 47 is substituted for swivel joint 44. In another alternative embodiment of reel assembly 10 in which rope or cable is wound about reel 24, no rotating connection is required). Terminal end 22 of air hose 12 may be equipped with a conventional hose stop 48 to prevent air hose 12 from being withdrawn completely into cabinet 14. A snubbing roller 52 is attached to subframe 34 to act as a guide to constrain air hose 12 to wind onto reel 24. A uni-directional viscous clutch assembly 50 discussed more fully hereinafter, is disposed between reel 24 and support shaft 32 to provide a viscous retarding force that governs the retraction speed of reel 24 but does not inhibit the free paying-out of hose 12 from reel 24.

FIG. 3 is an exploded perspective view of a viscous clutch assembly 50 incorporating principles of the present invention. Viscous clutch assembly 50 comprises a housing 54 having apertures 56 adapted to be bolted to corresponding apertures 58 passing through outer and inner reel halves 24A and 24B (FIG. 2). Housing 54 includes an annular chamber 60 having a radially inward wall 62 and a radially outward wall 64. A unidirectional clutch assembly 66 includes a collar member 68 and a unidirectional clutch 70. Unidirectional clutch 70 is a press-fit in bore 72 of collar member 68 and/or may be retained by conventional anaerobic adhesives such as LOCTITE, such that unidirectional clutch 70 is rigidly attached to collar member 68 without the possibility of rotation therebetween. Unidirectional clutch assembly is disposed in chamber 60 such that keyed surface 74 is completely within chamber 60 while sealing surface 76 protrudes beyond flush with surface 78 of housing 54. A radial seal such as a conventional O-ring 80 seals inner-bore 72 of collar member 68 to radially inward wall 62 of chamber 60 thereby providing a fluid tight seal therebetween.

A plurality of vanes are disposed in chamber 60 to provide the viscous damping action, for example, in the illustrative embodiment, the vanes constitute stator disks 82 and rotor disks 84 each comprising disks of a hollow substantially circular cross-section that are disposed in chamber 60 in an alternating fashion with the rotor disks attached to the housing 54 and the stator disks 82 interleaved therebetween and attached to the collar member 68 to form a plurality of annular gaps between stator disks 82 and rotor disks 84. In the embodiment of FIG. 3, the rotor disks are attached to housing 54 by means of a plurality of tabs 86 extending radially outward from rotor disks 84 engaging a plurality of corresponding slots 88 formed in radially outward wall 64 of chamber 60, however, other means of attaching the rotor disks 84 to housing 54 such as splines, clips, adhesives, or other conventional methods are within the scope of the invention. Accordingly, as used herein, the term "attached" when used with reference to the interaction between the housing 54 and the rotor disks 84 means rigidly attached or attached in such a way so as to preclude substantial rotation therebetween. As used herein with reference to stator disks 82 and rotor disks 84, a hollow "substantially circular" cross-section means that the majority of the surface area of the disks lie within a hollow circular region defined by an inner radius and an outer radius, but does not preclude the presence of splines, tabs or other irregularities along the inner and outer radii.

The stator disks 82 are attached to collar member 68 by means of a plurality of tabs 90 that engage a plurality of corresponding slots 92 formed in keyed surface 74 of collar member 68. As with the attachment of the rotor disks 82 to housing 54, the attachment of stator disks 84 to collar member 68 may be accomplished with splines, clips, adhesives, or other conventional methods that preclude substantial rotational motion between the stator disks 82 and the collar member 68. Accordingly, as used herein with respect to the attachment of the stator disks 82 to the collar member 68, the word "attachment" means, when used with reference to the interaction between the collar member 68 and the rotor disks 84, rigidly attached or attached in such a way so as to preclude substantial rotation therebetween such as with splines or the tabs 86 and slots 88 of the embodiment of FIG. 3 by "substantially" precluding relative motion between the stator and rotor disks and the housing and collar member, respectively, what is meant is that the relative motion is not so great as to prevent the viscous dampener from acting to retard the velocity of the reel in a multiple revolution application. Accordingly, a quarter-turn, a half-turn or even more of tolerance between the disks and their respective housing 54 and collar member 68 is tolerable so long as the disks would be precluded from making more than one revolution relative to their respective housing 54 and collar member 68.

A cover 94 seals against surface 78 of housing 54. A conventional radial seal such as O-ring 96 is disposed in an O-ring groove 98. O-ring 96 seals cover 94 against sealing surface 76 of collar member 68 thereby providing a completely sealed chamber 60. Chamber 60 is then filled with a viscous fluid such as 30,000 CS silicone fluid through fill plugs 100 and 102. It should be noted that use of a plurality of stator and rotor disks in a single chamber enables viscous clutch assembly 50 to be of substantially more compact construction than the single plate viscous dampener of the prior art.

FIG. 4 is an end view of one unidirectional clutch assembly 66 comprising a ramp-and-ball or ramp-and-roller overrunning clutch assembly. In the embodiment of FIG. 4, collar member 68 and unidirectional clutch 70 are disposed about support shaft 32. Unidirectional clutch 70 comprises a plurality of balls or rollers 104 disposed within a cavity 106 defined by outer surface 108 of support shaft 32 and inner cylindrical surface 110 of unidirectional clutch 70. Outer surface 108 comprises a series of ramps 112 arranged in a saw tooth pattern around the perimeter of surface 110. The ramps are arranged such that the radial clearance between outer surface 108 of support shaft 32 at each of the tips 114 of ramps 112 is less than the diameter of rollers 104 and the radial clearance between surface 108 of shaft 32 and the root 116 of ramps 112 are greater than the diameter of rollers 114. Accordingly, as collar member 68 is rotated in the direction indicated by arrow A in FIG. 4, rollers 104 are jammed between outer-surface 108 of shaft 32 and inner-surface 110 of collar member 68 thus preventing substantial rotational motion between collar member 68 and shaft 32 (i.e. no more rotation than is necessary to effect the initial lock-up). Conversely as collar member 68 is rotated opposite the direction indicated by arrow A, roller members are freed to assume the orientation shown in FIG. 4 which permits them to slide easily over shaft 32 thereby providing substantially no resistance (i.e. other than ordinary friction) between collar member 68 and shaft 32 thereby permitting collar member 68 to freewheel about shaft 32.

Figure 5:
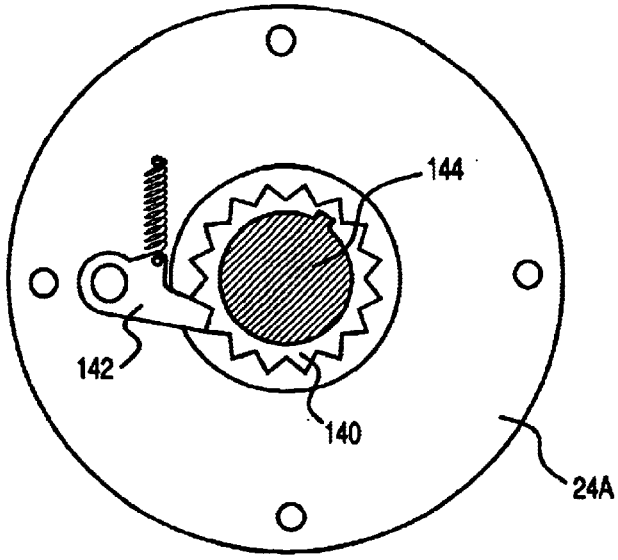
FIG. 5 is an end view of a ratchet and pawl unidirectional clutch assembly incorporating features of the present invention.

Although the embodiment of FIG. 4 comprises a ramp-and-ball or ramp-and-roller type of unidirectional clutch, other unidirectional clutch assemblies may be advantageously used in accordance with the principles of the present invention. As shown in FIG. 5, a ratchet and pawl clutch comprising ratchet gear 140 and ratchet pawl 142 may advantageously be used to provide the desired unidirectional clutching action. In the embodiment of FIG. 5, ratchet pawl 142 is attached to outer reel 24A and engages ratchet gear 140, which is keyed to shaft 144. Shaft 144 is in turn keyed to stator disks 82 (FIG. 3) of viscous clutch assembly 50 which, in turn, is supported by subframe 34. Although both the embodiment of FIG. 3 and the embodiment of FIG. 4 effect an operative unidirectional viscous damping between the reel and the support, in the embodiment of FIG. 3 the unidirectional viscous damping is effected by the unidirectional clutch disengaging the viscous damper from the support. In contradistinction, in the embodiment of FIG. 4, the unidirectional viscous damping is effected by the unidirectional clutch disengaging the reel from the viscous clutch.

Figure 6:
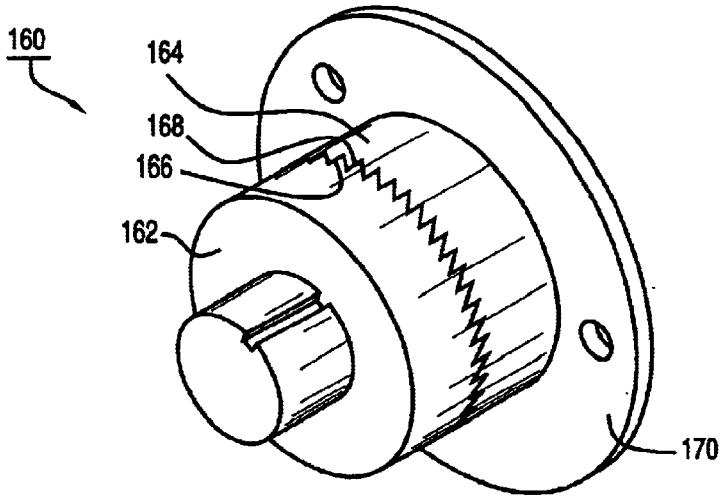
FIG. 6 is a perspective view of a saw tooth axial gear coupling unidirectional clutch assembly incorporating features of the present invention.

FIG. 6 depicts an alternative embodiment in which the unidirectional clutch comprises a saw tooth axial gear coupling 160. Coupling 160 comprises hubs 162 and 164 each having a plurality of mating axially-engaging gear teeth 166 and 168 having a saw tooth profile. Flange 170 of coupling 160 is attached to outer reel 24A while hub 162 is keyed to stator disks 82 of viscous clutch assembly 50 (FIG. 3) as discussed above. Hub 162 and 164 are biased together by an axial spring (not shown) acting on hub 162 such that the engagement of axially-engaging gear teeth 166 and 168 is maintained when hub 164 is rotated in a first direction, but the axially-engaging gear teeth 166 and 168 disengage and skip relative to each other when hub 164 is rotated in the opposite direction.

Figure 7:
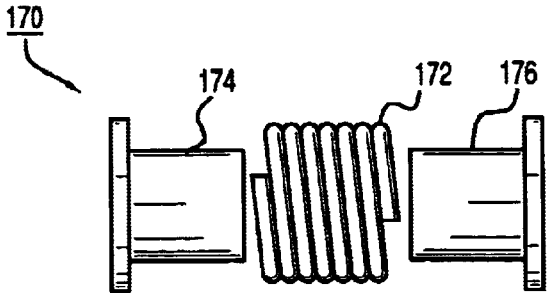
FIG. 7 is an exploded side elevation view of a helical spring clutch unidirectional clutch assembly incorporating features of the present invention.
Figure 8:
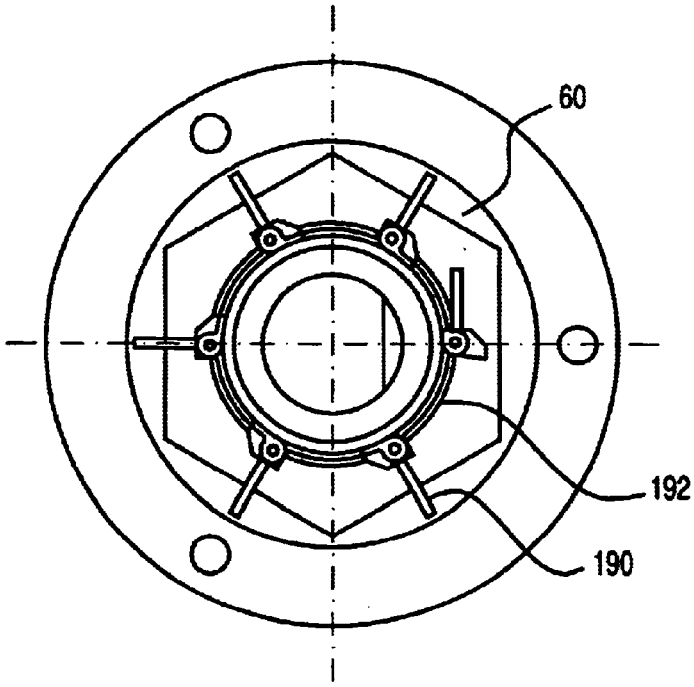
FIG. 8 is an end view of an alternative embodiment of a viscous clutch incorporating features of the present invention.
Figure 9:
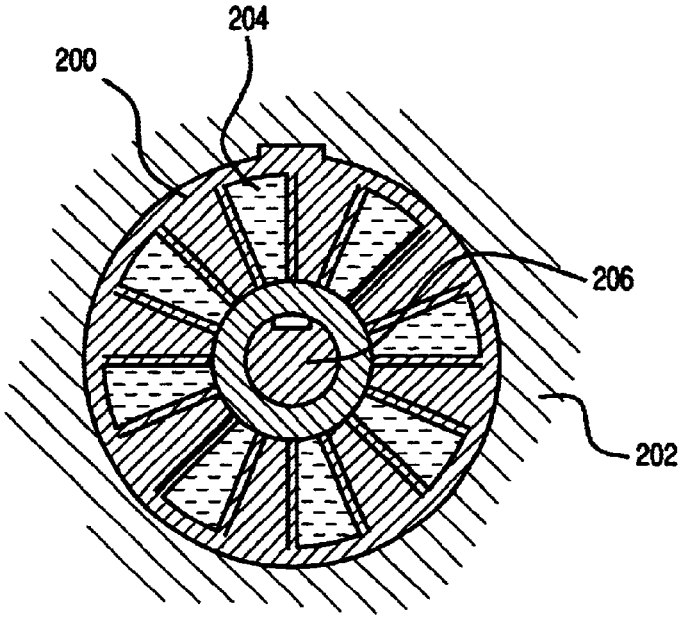
FIG. 9 is an end view of an alternative embodiment of a viscous clutch incorporating features of the present invention.

FIG. 7 depicts an alternative embodiment in which the unidirectional clutch comprises a helical spring clutch 170. Helical spring clutch 170 comprises a helical spring 172 that has a slight interference fit over hub 174 and hub 176. As can be determined with reference to FIG. 7 if the relative rotation of hub 174 relative to hub 176 is opposite the direction of wind of helical spring 172, spring 172 will tend to expand and transmit very little torque, whereas if the rotation reverses, spring 172 will tend to contract and will transmit substantial torque between hub 174 and 176. Where, as in the present invention, the disengaged rotational speeds are relatively low, frictional heating is not of concern and, therefore a simple inexpensive clutch such as the embodiment of FIG. 7 may be preferred.

With reference again to the embodiment of FIGS. 1–4, with the unidirectional clutch 70 oriented such that the direction indicated by arrow A in FIG. 4 corresponds to the take-up direction, as hose 12 is unwound from the reel 24, roller members 104 of unidirectional clutch 70 disengage from shaft 32 thereby permitting collar member 68 (and with it the rest of reel assembly 10) to freewheel without substantial resistance from viscous clutch assembly 50 (by substantial resistance, what is meant herein is that only nominal rotating friction associated with the freewheeling parts of viscous clutch assembly 50 as opposed to the substantial viscous damping caused by shearing of the fluid within viscous clutch assembly is exerted). When operated in this direction, reel assembly 10 rotates about support shaft 32 resisted primarily the torque exerted by torsional spring 38. When hose 12 is released, the rewind force developed by torsional spring 38 causes rotation of reel 24 in the take-up direction indicated by arrow A of FIG. 4. As this occurs, roller members 104 of unidirectional clutch 70 assume the engaged position against shaft 32 thereby preventing relative motion between collar member 68 and shaft 32. Stator disks 82, which are attached to collar member 68 therefore are held stationary within chamber 60 of housing 54, while rotor disks 84 rotate with housing 54 and reel 24 under the urging of torsional spring 38. As this occurs, the silicone fluid filling the gaps between rotors 84 and stators 82 is sheared, thereby giving rise to a viscous retarding force that is proportional to the relative velocity between rotor disks 84 and stator disks 82. Since this viscous retarding force is proportional to velocity, the retarding force will be small as the hose reel begins to move and will build as the velocity of the hose reel increases, until the retarding force balances the torque exerted by the torsion spring 38. Once the torques are equal, the hose reel will assume a constant rotational velocity thereby smoothly retracting the hose 12 onto reel 24 at a controlled retraction rate. As is evident from the foregoing, use of a uni-directional viscous clutch assembly 50 enables a controlled retraction rate to be effected without limiting the rate at which the hose may be payed-out, thus achieving the safety advantages of a viscous retarding mechanism without the deleterious effects of a bi-directional viscous dampener on the life of the hose and/or the remaining components of the hose reel assembly.

Although certain preferred embodiments and methods have been disclosed herein, it will be apparent from the foregoing disclosure to those skilled in the art that variations and modifications of such embodiments and methods may be made without departing from the spirit and scope of the invention. For example, although in the illustrative embodiment of FIGS. 1–4 the vanes that provide the viscous dampening comprise rotors and stators that shear a viscous fluid, other velocity-proportional viscous dampening assemblies may be advantageously used in accordance with the present invention, such as turbine vanes or, as shown in FIG. 7, a plurality of vanes 190 attached to a hub 192 disposed within chamber 60 containing the viscous fluid. Each of vanes 190 has a pivot 194 that permits the vane 190 to fold radially inward when reel 24 is rotated in a first direction, thereby disengaging the damping apparatus from reel 24. Each of vanes 190 also has a stop 196 that allows the vane 190 to deploy radially outward and stop when reel 24 is rotated in a second direction, thereby causing the vanes 190 to exert a viscous retarding torque on reel 24 when it is rotated in the second direction. Accordingly, it is intended that the invention shall be limited only to the extent required by the appended claims and the rules and principles of applicable law.

What is claimed is:

1. An apparatus for storing an elongate member comprising:

a support frame;

a spool rotatably supported by said support frame, said spool having a cylindrical body and a pair of flanges extending radially outward from opposite ends of said cylindrical body;

an elongate member wound about said spool, said elongate member having a free end extending from said support frame and a fixed end fixed to said spool;

a spring rewind motor operatively disposed between said support frame and said spool, said spring rewind motor exerting a torque on said spool for counteracting a rotational displacement of said spool in a first rotational direction caused by the paying out of said elongate member from said spool;

a viscous clutch assembly operatively disposed between said spool and said support frame to exert a retarding torque between said spool and said support frame, said viscous clutch assembly comprising a housing defining a sealed chamber, a viscous liquid contained therein, and a plurality of vanes disposed in said sealed chamber; and a unidirectional clutch assembly operatively disposed between said spool and said support frame, said unidirectional clutch assembly operating to disengage said viscous clutch assembly when said spool is rotated in said first rotational direction, thereby permitting the unwinding of said elongate member from said spool without said viscous clutch exerting a substantial retarding torque, said unidirectional clutch assembly further operating to engage said viscous clutch assembly such that said viscous clutch exerts a retarding torque between said spool and said frame for limiting rotational velocity of said spool when said spool is rotated in a second rotational direction for rewinding said elongate member onto said spool.

2. The apparatus of claim 1, wherein:

said unidirectional clutch assembly comprises a ramp and ball overrunning clutch.

3. The apparatus of claim 1, wherein:

said unidirectional clutch assembly comprises a ratchet and pawl.

4. The apparatus of claim 1, wherein:

said unidirectional clutch assembly comprises a sawtooth axial gear clutch.

5. The apparatus of claim 1, wherein:

said unidirectional clutch assembly comprises a ramp and roller overrunning clutch.

6. The apparatus of claim 1, wherein:

said unidirectional clutch assembly comprises a helical spring clutch.

7. The apparatus of claim 1, wherein:

said vanes comprise a plurality of stator disks and rotor disks defining a plurality of annular gaps therebetween, such that said viscous liquid is sheared in said plurality of annular gaps to provide a multi-plate viscous dampening.

8. The apparatus of claim 1, wherein:

said vanes comprise a plurality of turbine vanes.

9. The apparatus of claim 1, wherein:

said vanes comprise a plurality of paddles.

10. An apparatus for storing an elongate member comprising:

a support frame;

a spool rotatably supported by said support frame, said spool having a cylindrical body and a pair of flanges extending radially outward from opposite ends of said cylindrical body;

an elongate member wound about said spool, said elongate member having a free end extending from said support frame and a fixed end fixed to said spool, said free end of said elongate member unwinding from said spool when said spool is rotated in a first rotational direction;

a spring rewind motor operatively disposed between said support frame and said spool, said spring rewind motor exerting a torque on said spool for retracting said elongate member onto said spool in a second rotational direction; and a unidirectional speed retarding apparatus disposed between said spool and said support frame, said unidirectional speed retarding apparatus comprising viscous clutch means and unidirectional clutch means, said viscous clutch means comprising means for providing a velocity-dependent retarding torque between said spool and said support frame, said unidirectional clutch means comprising means for disengaging said viscous clutch assembly when said spool is rotated in said first rotational direction for unwinding said elongate member, thereby permitting said spool to rotate without said viscous clutch exerting a substantial retarding torque, said unidirectional clutch means further comprising means to engage said viscous clutch assembly such that said viscous clutch exerts a retarding torque between said spool and said frame for limiting rotational velocity of said spool when said spool is rotated in said second rotational direction for retracting said elongate member.

11. The apparatus of claim 10, wherein:

said unidirectional clutch means comprises a ramp and ball overrunning clutch.

12. The apparatus of claim 10, wherein:

said unidirectional clutch means comprises a ratchet and pawl.

13. The apparatus of claim 10, wherein:

said unidirectional clutch means comprises a sawtooth axial gear clutch.

14. The apparatus of claim 10, wherein:

said unidirectional clutch means comprises a ramp and roller overrunning clutch.

15. The apparatus of claim 10, wherein:

said unidirectional clutch means comprises a helical spring clutch.

16. The apparatus of claim 10, wherein:

said viscous clutch means comprises a plurality of stator disks and rotor disks defining a plurality of annular gaps therebetween, such that said viscous liquid is sheared in said plurality of annular gaps to provide a multi-plate viscous dampening.

17. The apparatus of claim 10, wherein:

said viscous clutch means comprise a plurality of turbine vanes.

18. The apparatus of claim 10, wherein:

said vanes comprise a plurality of paddles.

19. An apparatus for storing an elongate member comprising:

a support frame;

a spool rotatably supported by said support frame for supporting an elongate member wound thereabout, said spool being capable of rotating in a first direction for paying out a length of said elongate member and in a second direction for rewinding said elongate member;

a spring rewind motor operatively disposed between said support frame and said spool, said spring rewind motor exerting a torque on said spool urging said spool in said second direction for rewinding said elongate member;

a viscous clutch assembly operatively disposed between said spool and said support frame to exert a retarding torque between said spool and said support frame, said viscous clutch assembly comprising a housing defining a sealed chamber, a viscous liquid contained therein, and a plurality of vanes disposed in said sealed chamber; and a unidirectional clutch assembly operatively disposed between said spool and said support frame, said unidirectional clutch assembly operating to disengage said viscous clutch assembly when said spool is rotated in said first rotational direction and to engage said viscous clutch assembly when said spool is rotated in said second direction such that said viscous clutch exerts a retarding torque on said spool for limiting a rotational velocity of said spool when said spool is rewinding said elongate member, but does not exert a retarding torque on said spool when said spool is unwinding said elongate member.

20. The apparatus claim 19, wherein:

said vanes comprise a plurality of stator disks and rotor disks defining a plurality of annular gaps therebetween, such that said viscous liquid is sheared in said plurality of annular gaps to provide a multi-plate viscous dampening.

21. An apparatus for storing an elongate member comprising:

a support frame;

a spool rotatably supported by said support frame, said spool having a cylindrical body and a pair of flanges extending radially outward from opposite ends of said cylindrical body;

an elongate member wound about said spool, said elongate member having a free end extending from said support frame and a fixed end fixed to said spool;

a spring rewind motor operatively disposed between said support frame and said spool, said spring rewind motor exerting a torque on said spool in a rewind direction for counteracting a rotational displacement of said spool in a first rotational direction caused by the paying out of said elongate member from said spool; and means for applying a unidirectional viscous torque on said spool to limit the rotational velocity of said spool only in the rewind direction.

* * * * *